US006655871B1

(12) United States Patent
Riedl

(10) Patent No.: US 6,655,871 B1
(45) Date of Patent: Dec. 2, 2003

(54) VIBRATION EXCITER FOR GROUND COMPACTING DEVICES

(75) Inventor: Franz Riedl, München (DE)

(73) Assignee: Wacker Construction Equipment AG, Munich (DE)

( * ) Notice: Subject to any disclaimer, the term of this patent is extended or adjusted under 35 U.S.C. 154(b) by 0 days.

(21) Appl. No.: 10/070,891

(22) PCT Filed: Sep. 8, 2000

(86) PCT No.: PCT/EP00/08806

§ 371 (c)(1),
(2), (4) Date: Mar. 7, 2002

(87) PCT Pub. No.: WO01/19535

PCT Pub. Date: Mar. 22, 2001

(30) Foreign Application Priority Data

Sep. 10, 1999 (DE) ..... 199 43 391

(51) Int. Cl.[7] ..... E01C 19/38; E01C 19/40
(52) U.S. Cl. ..... 404/113; 404/114
(58) Field of Search ..... 404/133.05, 133.1, 404/113, 114

(56) References Cited

U.S. PATENT DOCUMENTS 3,736,066 A 5/1973 Koontz
3,878,733 A * 4/1975 Tertinek ..... 404/113
4,398,431 A 8/1983 Melnick
4,499,779 A * 2/1985 Maass ..... 74/61
6,394,697 B1 * 5/2002 De Boer ..... 404/133.1

FOREIGN PATENT DOCUMENTS

DE 3 609 360 9/1987
DE WO98/03735 * 7/1997
EP 0 840 191 5/1998

* cited by examiner

*Primary Examiner*—Thomas B. Will
*Assistant Examiner*—Raymond Addie
(74) *Attorney, Agent, or Firm*—Boyle Fredrickson Newholm Stein & Gratz S.C.

(57) ABSTRACT

A vibration exciter for a ground compacting devices such as a vibratory plate comprises unbalanced shafts which are arranged parallel or coaxial to one another, which can be driven in counter-rotation with the same rotational speed, and which each carry at least one centrifugal weight, whereby the phase position of the centrifugal weights can be adjusted by a phase adjusting device in such a manner that the vertical components of the centrifugal forces generated by the centrifugal weights are cancelled out in each rotational position. At the same time, the horizontal components of the centrifugal forces are correspondingly added in the same direction. This phase position prevents the vibratory plate, when stationary, from introducing any vertical vibration into the ground to be compacted, but enables it to introduce shear stresses via a ground contact plate into the ground, preferably an asphalt surface, in order to compact cracks and pores.

12 Claims, 3 Drawing Sheets

VIBRATION EXCITER FOR GROUND COMPACTING DEVICES

BACKGROUND OF THE INVENTION

1. Field of Invention

The invention relates to a vibration exciter which is used especially in ground compaction devices.

2. Description of the Related Art

Ground compaction devices, especially vibrating or oscillating plates, comprise a ground contact plate that is movable over the ground to be compacted and is subjected to the action of a vibration generated by a vibration exciter. The shaking movement necessary for this effects a reciprocal sliding and displacement of the substrate particles, whereby intervening spaces can be filled and the desired ground compaction achieved.

Many solutions are known for providing such vibration exciters. In practice, an arrangement that has proven especially successful is one in which two mutually parallel shafts are driven to rotate in opposite directions at the same speed of rotation. Each of the shafts carries one or more centrifugal weights, so that the centrifugal weights also rotate in opposite directions to one another and generate an imbalance. In order to achieve a phase position that is constant over the rotation, the shafts carry mutually engaging gear wheels. The phase position is selected so that the resultant force from the rotating centrifugal weights and hence from the centrifugal forces adopts a desired direction.

It is particularly advantageous if the phase position between the centrifugal weights or eccentric shafts can be adjusted, as a result of which the orientation of the resultant vibration or of the resultant force becomes adjustable to suit the operator's requirements. For this purpose, it is known, for example from DE 30 43 719 C2, for it to be possible for one of the eccentric shafts to be twisted relative to a gear wheel, which engages with a gear wheel of the other eccentric shaft and generally ensures a solid coupling of the rotational movement.

Other examples of vibration exciters are described in DE 36 09 360 and in DE 35 45 593 C2.

FIG. 5 shows a diagrammatic lateral view of a vibration exciter known from DE 29 09 204 C2.

Two mutually parallel eccentric shafts 1, 2 are driven to rotate in opposite directions and at the same speed of rotation, as indicated by the arrows A and B. Each of the eccentric shafts 1, 2 carries a centrifugal weight 3, 4, as a result of which the centrifugal forces 5 and 6 indicated by arrows arise. For the sake of simplification, the reference numerals will not be repeated in any of the other drawings. The arrangement is the same on each occasion, but in different positions in each case.

FIG. 5*a*) shows the known vibration exciter, in which the phase position is regulated by a phase regulating device (not shown), thus for example by the gear wheel which is twistable relative to one of the eccentric shafts 1, 2, in a manner such that the centrifugal forces 5, 6 act, in an obliquely upward direction, in other words with a vertical component and a forward-directed horizontal component. For this purpose, a force chart is also shown in FIG. 5*a*.

The precise sequence of a 180° rotation of the eccentric shafts 1, 2 with the centrifugal forces 5, 6 is shown in 45° steps in FIG. 6. The rotation of the centrifugal weights 3, 4 in the constant phase position shown has the effect, because of the resultant forces, that the oscillating plate carrying the vibration exciter is moved forward, toward the left in FIG. 6. The vertical component relieves the load on the ground contact plate or even lifts it slightly above the ground, while the horizontal component provides the desired forward drive.

FIG. 5*b*) shows the vibration exciter with the phase position changed. In this case the eccentric shaft 2 and the centrifugal weight 4 have been twisted through an angle of 90° relative to the eccentric shaft 1 with the centrifugal weight 3 in order to reach the phase position shown in FIG. 5*b*). In a manner corresponding to this, FIG. 7 shows a 180° cycle in 45° steps. It is apparent from this that, in the phase position shown in FIG. 5*b*) and FIG. 7, no resultant horizontal forces arise, while the vertical forces are cumulative to a maximum extent. In this phase position, consequently, the oscillating plate remains stationary and effects a maximum compaction of the ground as a result of maximum vertical movement.

In addition, FIG. 5*c*) also shows the phase position of the eccentric shafts 1, 2 for the rearward travel of the oscillating plate (toward the right in the figure).

It is common to all vibration exciters known from the prior art that, at what is known as the turn-round or reversal point, in other words in the phase position where the oscillating plate is stationary (FIG. 5*b*), the resultant centrifugal force vector is oriented vertically. The force acting on the ground to be compacted is thus greatest in this position and reduces during forward or rearward travel of the plate and the swinging of the resultant force vector associated therewith by, for example, 45° forward or rearward, to $1/\sqrt{2}$ of the maximum value.

The arrangements described have proven outstandingly successful in the compaction of earth, sand and gravel, as compaction can be carried out with maximum application of force at selected points.

Problems arise, however, with oscillating plates having vibration exciters such as are to be used for the compaction of asphalt or paving. The problem here is that if the maximum vertical force acts at the reversal point, localized subsidence may occur that can no longer be corrected. With asphalt rollers, therefore, it is customary to switch off the vibration in the reversal area in order to avoid excessive penetration of the roller into the asphalt during the change of direction.

It is an object of the present invention to provide a vibration exciter for ground compaction devices whereby an excessive action on certain substrates, such as asphalt or paving, when the machine is being reversed or is stationary can be avoided.

According to the invention, this object is achieved by a vibration exciter having the features of patent claim 1. Advantageous further developments of the invention can be found in the dependent claims.

OBJECTS AND SUMMARY OF THE INVENTION

A vibration exciter according to the invention for ground compaction devices comprises mutually parallel or coaxial eccentric shafts capable of being driven in opposite directions at the same speed of rotation and each carrying at least one centrifugal weight. In such a vibration exciter, it is a particular feature of the invention that the phase position of the centrifugal weights can be regulated by means of a phase regulating device in a manner such that the vertical components of the centrifugal forces generated by the centrifugal weights in each position of rotation cancel each other out. It is thus made possible, according to the invention, to regulate a phase position in which the vertical components of the centrifugal weights cancel each other out, so that the resultant force of the centrifugal forces comprises no vertical component and no vertical vibration at all acts on the substrate to be compacted. Despite sustained operation of the vibration exciter and thus rotation of the centrifugal forces, further compaction of the substrate can thus be avoided.

A particularly advantageous embodiment of the invention is one wherein the horizontal components of the centrifugal forces act cumulatively in the same direction in this phase position. The resultant force vector thus comprises a maximum horizontal component. This makes it possible to apply a high shearing stress, for example into the asphalt surface, via the ground contact plate in order to smooth over relatively small cracks or pores. As resultant horizontal forces are generated in each of the two directions (forward and rearward) during a 360° rotation of the centrifugal weights, the ground compaction device remains virtually stationary.

A further, particularly advantageous embodiment of the invention is one wherein, in order to effect a movement of the ground compaction device in a first direction, the phase position defined for stationary positioning can be adjusted through a positive angle, while in order to effect a movement in a second direction opposite to the first-direction, the phase position can be adjusted through a negative angle. It is thus possible to exploit the advantages already provided by the vibration exciters known from the prior art for the forward and rearward drive of the ground compaction devices.

It is particularly advantageous, however, if, in the event of a change between forward and rearward travel, in other words a change between the first and second directions, the phase position defined according to the invention for the stationary or reversal point can be adopted transitorily. If, then, the operator changes between forward travel and rearward travel, the vertical vibrations are automatically reduced to zero at the reversal point, so that the operator need take no further precautions to protect the substrate to be compacted.

An advantageous further development of the invention is one wherein the phase position can be regulated in a manner such that the horizontal components of the centrifugal forces cancel each other out and the vertical components act cumulatively in the same direction.

As a result, it is also possible to regulate a phase position which ensures the advantages of the vibration exciters previously known from the prior art, in particular a maximum compaction output when the machine is stationary.

A further advantageous embodiment is one wherein the phase regulating device comprises at least one device for superimposing on the contrary rotation of the eccentric shafts the twisting of, in each case, one of the centrifugal weights relative to an associated other centrifugal weight. The phase regulating device, whose structure and mode of operation are known in principle from the prior art printed publications cited above, can thus be combined from a plurality of units in order to satisfy the versatile regulatory possibilities of the phase position provided according to the invention.

These and further advantages and features of the invention are explained below with reference to the accompanying figures, in which:

DETAILED DESCRIPTION OF THE PREFERRED EMBODIMENTS

As previously mentioned above, vibration exciters are known in many different constructions. Likewise, phase regulating devices are known—for example from the cited prior art printed publications—whereby the phase position of the centrifugal weights carried by the eccentric shafts can be changed. As the invention relates not to the detailed and specific configuration of a particular vibration exciter or a particular phase regulating device but, rather, to a phase position that is particularly suitable therefor but not previously known, a description of a specific embodiment is not necessary.

It is however familiar to the person skilled in the art that the phase regulating device must be suitable for regulating the relative position of the centrifugal weights on the eccentric shafts with superimposition of the coupled rotational movement in opposite directions. For this purpose it is possible, for example, for the eccentric shafts to be coupled by mutually engaging gear wheels, it being possible to vary the position of a gear wheel relative to the associated eccentric shaft as a result of which the phase position of the centrifugal weights also changes. This principle has proven outstandingly successful in practice and is—as already shown—described for example in DE 29 09 204 C2, which in turn refers to further prior art to which the present invention can be applied.

The vibration exciter may be, for example, an exciter having two parallel shafts, each of which carries a centrifugal weight , the centrifugal weights of the two eccentric shafts being disposed opposite one another. Such a vibration exciter is also known from DE 29 09 204 C2.

In another vibration exciter, known for example from DE 30 43 719 C2, each of the eccentric shafts carries two centrifugal weights , which are offset coaxially. In yet another vibration exciter, it is possible to change the positions relative to one another of centrifugal weights disposed coaxially on an eccentric shaft , in order for example to effect a steering movement of the oscillating plate.

As previously stated, the invention can be applied to all these vibration exciters.

Figure 1:
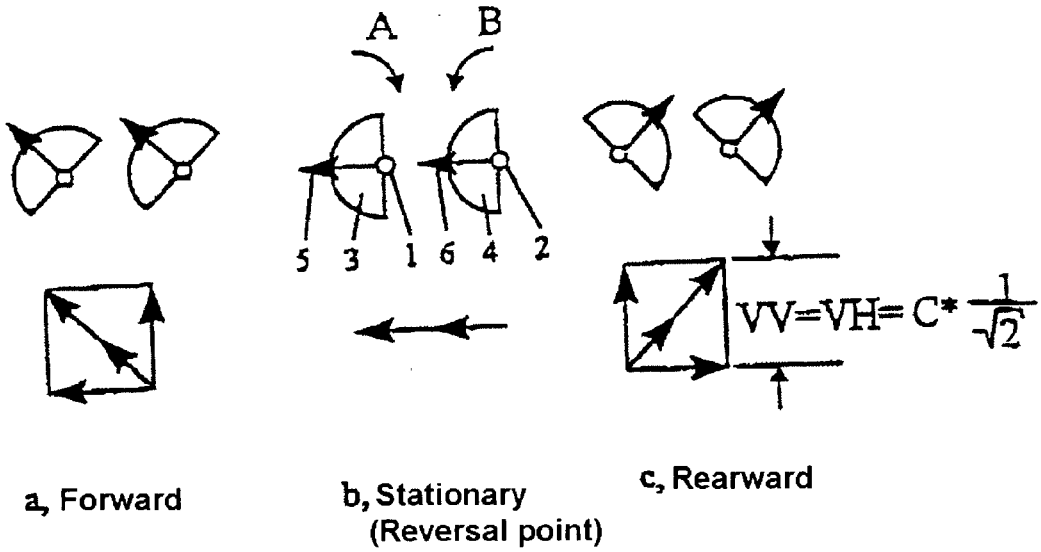
FIG. 1 shows a vibration exciter according to the invention in various phase positions, in a diagrammatic lateral view.

FIG. 1 shows an overview of the phase positions provided according to the invention, FIG. 1*a*) relating to a forward travel of the oscillating plate (toward the left in the figure), FIG. 1*b*) to a phase position at the stationary or reversal point, and FIG. 1*c*) to the phase position for the rearward travel of the oscillating plate.

An essential aspect of the invention is shown in FIG. 1*b*) and 2, which relate to the phase position in which the oscillating plate is stationary. In the initial position shown in FIG. 1*b*) and 2*a*), the eccentric shafts 1, 2 with the centrifugal weights 3, 4 are so positioned relative to one another that the centrifugal forces 5, 6 lie in the horizontal direction and cumulatively produce a maximum value.

Figure 2:
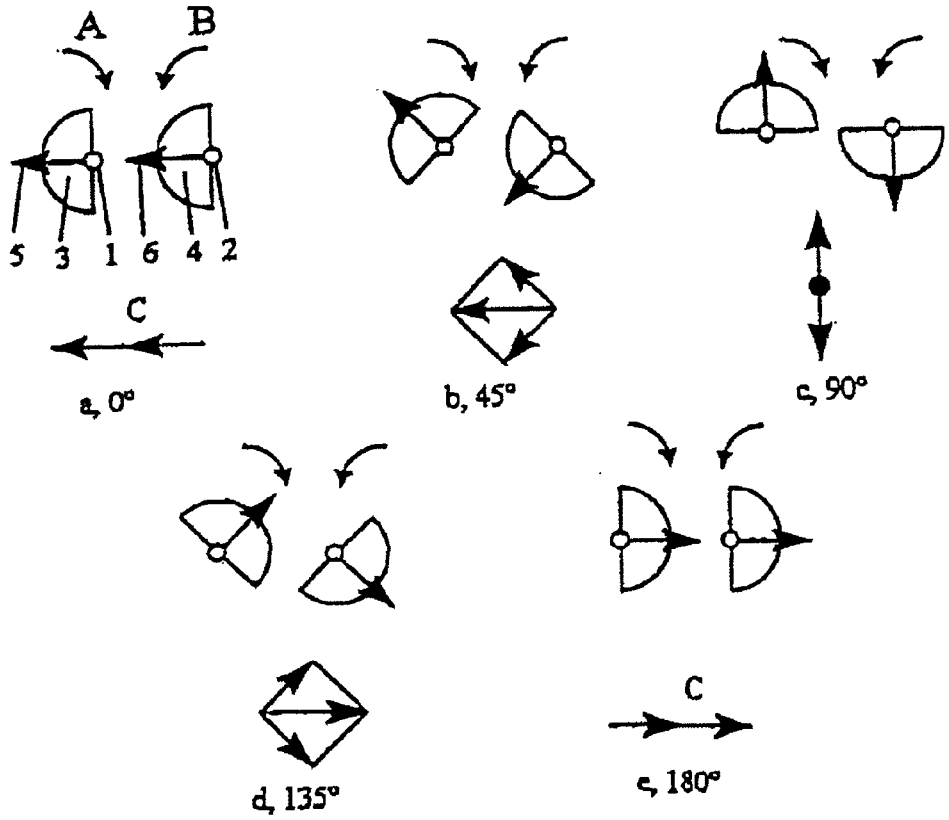
FIG. 2 shows various positions of rotation of the vibration exciter in the phase position shown in FIG. 1*b*)

In the course of further rotation, identified by the arrows A and B, which is shown in 45° steps in FIGS. 2*a*) to 2*e*), the vertical components of the centrifugal forces 5, 6 cancel each other out in each case, while the horizontal components are cumulative and thus change their direction in the course of a 180° cycle.

This means that the oscillating plate does not rise clear of the ground and applies no vertical vibration to the ground. Instead, the oscillating plate is dragged alternately forward and rearward, without significantly changing its position, so that shearing forces act into the ground and, for example, in the case of asphalt can close pores or cracks.

Figure 3:
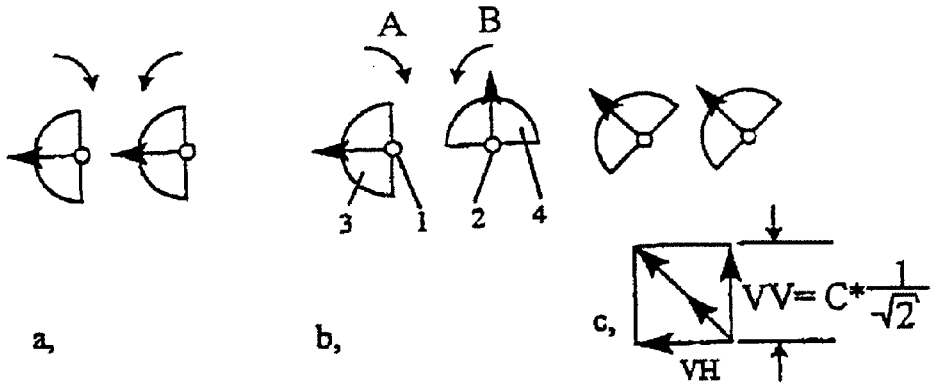
FIG. 3 shows a transition from the phase position shown in FIG. 1*b*) to the phase position shown in FIG. 1*a*)

FIG. 3 shows the change of phase position when the device is switched from the reversal point into the forward position.

In this case, FIG. 3*a*) takes up the phase position for the reversal position shown in FIG. 1*b*). The phase position is then changed by means of the phase regulating device (not shown) in a manner such that the eccentric shaft 2 with the centrifugal weight 4 is twisted through an angle of −90° (in accordance with the mathematical direction of rotation) relative to the eccentric shaft 1 with the centrifugal weight 3. It should be pointed out that this twisting takes place simultaneously with, in other words is superimposed upon, the continuously occurring, coupled rotation in opposite directions.

FIG. 3*c*) then shows, in the same phase position as FIG. 3*b*), the position for forward travel, in which both resultant vertical and horizontal components arise, which move the oscillating plate forward in a manner such as is known from the prior art.

Figure 4:
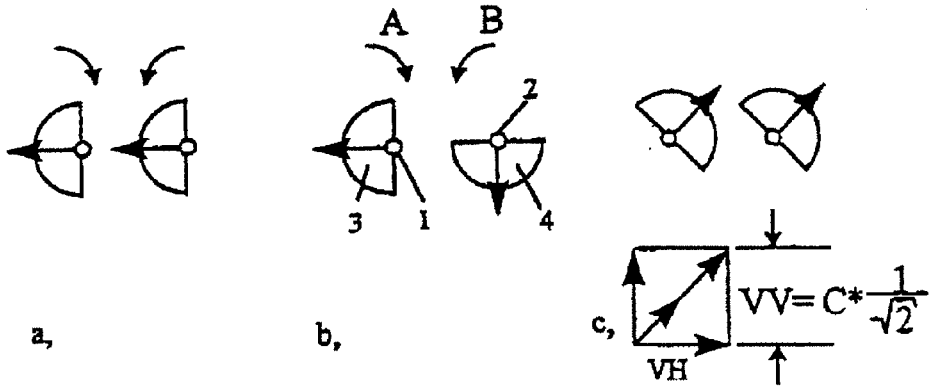
FIG. 4 shows a transition from the phase position shown in FIG. 1*b*) to the phase position shown in FIG. 1*c*)
Figure 5:
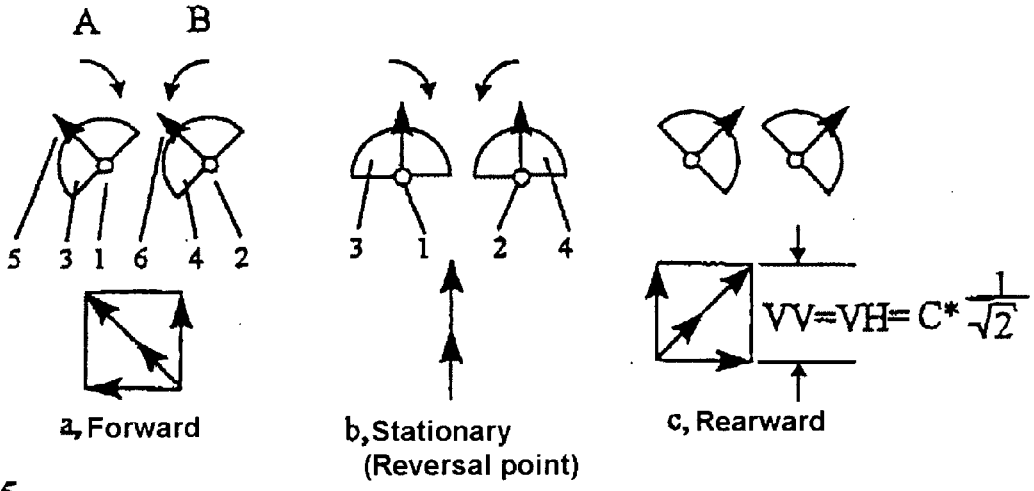
FIG. 5 shows various phase positions in a vibration exciter known from the prior art.
Figure 6:
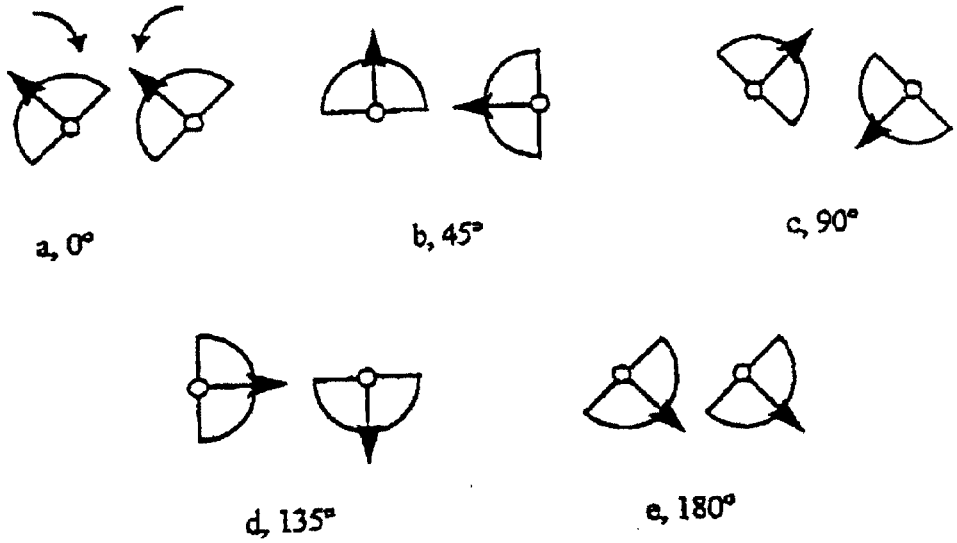
FIG. 6 shows various positions of rotation for the phase position shown in FIG. 5*a*)
Figure 7:
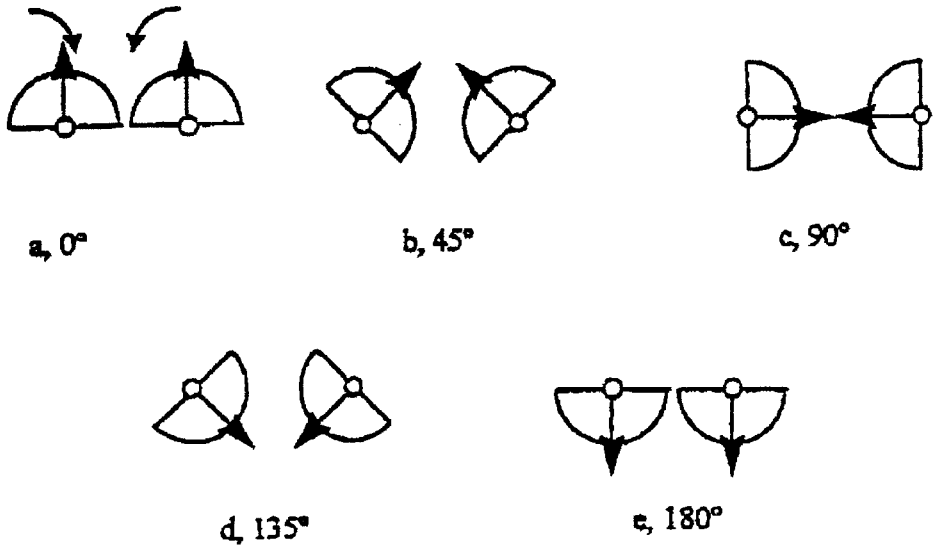
FIG. 7 shows various positions of rotation for the phase position shown in FIG. 5*b*).

In addition, FIG. 4 also shows the switching from the reversal position (FIG. 4*a*)) into rearward travel (FIG. 4*b*)). For this purpose, the phase position is changed so that the second eccentric shaft 2 is displaced through an angle of +90° relative to the first eccentric shaft 1. Here again, the twisting is superimposed by the phase regulating device on the continuously coupled rotation in opposite directions, so that the position shown in FIG. 4*c*) can be reached.

It is of course entirely a matter for the discretion of the person skilled in the art also to twist the eccentric shaft 1 as well as, or exclusively and instead of, the eccentric shaft 2, in order to produce the desired phase position.

It is essential to the invention that said phase positions can be regulated. The devices necessary for this purpose are known in principle but have not hitherto been used in the manner according to the invention.

In the vibration exciters known from the prior art, the phase regulating device customarily consists of an individual unit which permits the desired adjustment of the phase position. In view of the wide range of phase positions opened up by the invention, it may be expedient to provide a plurality of devices in the vibration exciter, each of which is suitable for changing the phase position over a particular range, so that as a result of the cumulative effect of all the changes any desired phase positions can be set.

It should be pointed out that, in the event of non-actuation of the phase regulating device, the phase position remains constant over the entire rotation of the eccentric shafts. Thus FIGS. 1*a*), 1*b*) and 1*c*) show three different phase positions, while FIG. 2 in illustrations a) to e) merely shows one phase position, but in different positions of rotation.

As a result of the invention, it is possible for the flyweights, at the reversal point, merely to generate a resultant horizontal force vector which decreases with increasing speed of movement and, when the phase position is changed and the force vector thus swung, for example to a value of 45° forward or rearward, reaches the value $1/\sqrt{2}$ C for the horizontal (VH) and vertical (VV) components, where C is the maximum achievable force value.

I claim:

1. A vibration plate for ground compaction comprising:

a vibration exciter, which includes at least two mutually parallel eccentric shafts capable of being driven in opposite directions at the same speed of rotation and each carrying at least one centrifugal weight, each centrifugal weight being capable of producing a centrifugal force having a vertical component and a horizontal component, and a phase regulating device which regulates the phase position of the centrifugal weights such that, in each phase position of each centrifugal weight, 1) the vertical components of the centrifugal forces generated by the centrifugal weights in each position of rotation cancel each other out, and 2) the horizontal components of the centrifugal forces generated by the centrifugal weights in each position of rotation act cumulatively in the same direction.

2. The vibration plate as claimed in claim 1, wherein, in order to effect a continuous movement of the ground compaction device in a first direction, the regulated phase position is adjustable through a positive angle to produce a first adjusted phase position.

3. The vibration plate as claimed in claim 2, wherein, in order to effect a continuous movement of the ground compaction device in a second direction opposite to the first direction, the regulated phase position is adjustable through a negative angle to produce a second adjusted phase position.

4. The vibration plate as claimed in claim 3, wherein, in the event of a change between the first and second adjusted phase positions, the regulated phase position can be adopted transitorily.

5. The vibration plate as claimed in claim 1, wherein the phase position can be regulated by the phase regulating device in a manner such that the horizontal components of the centrifugal forces cancel each other out and the vertical components of the centrifugal forces act cumulatively in the same direction.

6. The vibration plate as claimed in claim 1, wherein the phase regulating device comprises at least one device that, upon reversal of rotational direction of the eccentric shafts, superimposes the twisting of, each of the centrifugal weights relative to an associated other centrifugal weight.

7. A method comprising:

driving two mutually parallel eccentric shafts of a vibration exciter of a vibration plate in opposite directions at the same speed of rotation, each shaft carrying at least one centrifugal weight that is capable of producing a centrifugal force having a vertical component and a horizontal component, and regulating a phase position of the centrifugal weights such that, in each regulated phase position, 1) the vertical components of the centrifugal forces generated by the centrifugal weights in each position of rotation cancel each other out, and 2) the horizontal components of the centrifugal forces generated by the centrifugal weights in each position of rotation act cumulatively in the same direction.

8. The method as claimed in claim 7, further comprising adjusting the regulated phase position through a positive angle to produce a first adjusted phase position to effect a continuous movement of the ground compaction device in a first direction.

9. The method as claimed in claim 8, further comprising adjusting the regulated phase position through a negative angle to produce a second adjusted phase position to effect a continuous movement of the ground compaction device in a second direction.

10. The method as claimed in claim 9, further comprising transitorily adopting the regulated phase position in the event of a change between the first and second adjusted phase positions.

11. The method as claimed in claim 7, further comprising regulating the phase position with the phase regulating device in a manner such that the horizontal components of the centrifugal forces cancel each other out and the vertical components act cumulatively in the same direction.

12. The method as claimed in claim 7, further comprising, upon reversing a direction of rotation of the eccentric shafts, superimposing the twisting of each of the centrifugal weights relative to an associated other centrifugal weight.

* * * * *